United States Patent [19]

Sciacero et al.

[11] Patent Number: 4,710,767

[45] Date of Patent: Dec. 1, 1987

[54] METHOD AND APPARATUS FOR DISPLAYING MULTIPLE IMAGES IN OVERLAPPING WINDOWS

[75] Inventors: James R. Sciacero, Scottsdale; Douglas L. Pardee, Mesa, both of Ariz.

[73] Assignee: Sanders Associates, Inc., Nashua, N.H.

[21] Appl. No.: 757,126

[22] Filed: Jul. 19, 1985

[51] Int. Cl.[4] ..... G09G 1/16

[52] U.S. Cl. ..... 340/799; 340/721; 340/729; 340/723

[58] Field of Search ..... 340/716, 747, 721, 723, 340/732, 750, 729, 799, 798

[56] References Cited

U.S. PATENT DOCUMENTS

| | | | |
|---|---|---|---|
| 4,498,081 | 2/1985 | Fukushima et al. | 340/721 |
| 4,509,043 | 4/1985 | Mossaides | 340/721 |
| 4,559,533 | 12/1985 | Bass et al. | 340/721 |
| 4,651,146 | 3/1987 | Lucash et al. | 340/721 |
| 4,653,020 | 3/1987 | Cheselka et al. | 340/721 |
| 4,670,752 | 6/1987 | Marcoux | 340/721 |

FOREIGN PATENT DOCUMENTS

| | | | |
|---|---|---|---|
| 2100100 | 12/1982 | United Kingdom | 340/716 |

*Primary Examiner*—Gerald L. Brigance

*Attorney, Agent, or Firm*—Cahill, Sutton & Thomas

[57] ABSTRACT

A circuit is provided which receives pixel data and pixel addresses from a graphics processor and effectuates rapid clipping of image information lying outside of a corresponding window, and also provides a template memory for storing information corresponding to all areas of that window which are obscured by a higher priority window. The pixel addresses are simultaneously applied to an image memory, the template memory, and the window clipping circuit. A write control circuit enables a write signal produced by the graphics processor to be applied to a write input of the image memory only if the present pixel is located within the present window, as determined by the window clipping circuit, and is not in an obscured area of that window, as determined by the read-out of the template memory.

34 Claims, 6 Drawing Figures

METHOD AND APPARATUS FOR DISPLAYING MULTIPLE IMAGES IN OVERLAPPING WINDOWS

BACKGROUND OF THE INVENTION

The invention relates to apparatus and methods for effectuating screen display of multiple overlapping window images, and more particularly to apparatus and methods for updating an image memory that stores the pattern displayed on the screen.

Modern graphics computers, i.e., graphics processors, are capable of simultaneously executing, or essentially simultaneously, a plurality of separate graphics routines or programs, which may be dependent or independent. Typically, each of the graphics routines "assumes" that it has the entire CRT (cathode ray tube) display screen area available to it, and outputs pixel data, i.e., image data, accordingly. Techniques for simultaneously displaying a portion of each of the images produced by such separate graphics routines on a single screen are referred to as "windowing" techniques. Where multiple windows are provided to allow simultaneous display of portions of the various images on a single screen, various techniques have been utilized to prevent display of images outside of their respective windows, and, in a few instances, to prevent display of portions of images "obscured" by higher priority images, i.e., images in a higher priority window. In many prior windowing systems, the "clipping" of portions of a particular image outside the boundaries of a window is accomplished by executing elaborate clipping routines executed by the graphics processor. Although this approach provides the desired window clipping function, it requires extensive computing by the graphics processor, and requires extensive effort by the programmer who must write the software executed by the graphics processor; this approach also is very slow. A few prior graphics display systems have utilized software techniques within the image generating programs executed by the graphics processor to determine which areas of lower priority windows are obscured by higher priority windows. Such software techniques have been effectuated by cumbersome, time-consuming algorithms that must be executed by the graphics processor along with the image generating programs. The complexity of the software, the slowness of execution of such algorithms, and the burden upon the persons writing the software are so great that most computer graphics display systems simply avoid updating information in obscured windows.

Hardware approaches to the above-mentioned windowing functions have been proposed, both to clip portions of an image extending beyond a window predefined for that image, and to prevent display of portions of lower priority images that are obscured by higher priority images. The state-of-the-art is perhaps best illustrated in U.S. Pat. No. 4,412,296 (Taylor) and in "Principles of Interactive Computer Graphics" by William M. Newman and Robert F. Sproull, 1979, McGraw-Hill, Inc. Other references illustrative of the state-of-the-art include U.S. Pat. Nos. 3,639,736, 4,492,956, 4,500,875, 4,509,043, 4,278,973, and 4,475,161.

The technique described in the above-mentioned Taylor patent provides a hardware clipping technique for defining boundaries that "frame" higher priority symbology and prevent display of portions of lower priority symbology which would otherwise interfere with the display of the higher priority graphic symbols. However, this approach is generally unsuitable for dealing with the problem of updating bit mapped display memories, wherein every pixel of the screen is represented by a corresponding pixel code stored in the display memory, which is periodically read to update the screen image, and is occassionally updated by information received from the graphics processor. The technique described in the Taylor patent has the limitation that the number of allowed obscured boundarie's at any given x position is limited to one, for the disclosed circuitry. If additional obscured boundaries at that x coordinate are desired, the disclosed circuitry must be replicated for each. This is highly undesirable, because it would be desirable to provide a flexible graphics system that would allow the programmer to provide a large number of overlapping windows, and hence a large number of obscured areas. As a result of the complexity of prior software bit manipulation techniques that could be used to effectuate updating of an image display memory where multiple obscured window areas might occur, present bit mapped display systems utilizing image memories do not, to our knowledge, provide a mechanism for automatic updating, concurrently with image program processing, of multiple overlapping windows with partially obscured ones.

SUMMARY OF THE INVENTION

Accordingly, it is an object of the invention to provide an improved apparatus and method for updating display of multiple overlapping windowed images generated by a graphics processor with minimum control of the windowing function being performed by the graphics processor.

It is another object of the invention to provide a low cost, high speed technique for updating a display memory of graphics display system wherein multiple, overlapping windowed images are to be displayed.

It is an object of the invention to provide economical hardware in a graphics display system that allows rapid and convenient updating of an image memory, i.e., a display memory, wherein multiple obscured areas occur in a windowed image.

It is another object of the invention to provide a graphics display system wherein the number of obscured areas that can be utilized is not limited by the number of clipping circuits utilized.

It is another object of the invention to provide a windowing technique in which irregular obscured areas from overlapping windows can be utilized with minimum software burden on a graphics processor.

It is another object of the invention to provide a windowing technique in which irregularly shaped windows can be utilized and the necessary clipping associated therewith can be accomplished with minimum software burden on the graphics processor.

Briefly described, and in accordance with one embodiment thereof, the invention provides, in a graphics display windowing system, a template memory that is addressed essentially simultaneously with an image memory or display memory during graphics display operations, wherein the template memory stores a "template" or "bit mask" including information that identifies and corresponds to areas, such as areas of windows that are obscured by a higher priority window. In the described embodiment of the invention, the graphics processor initially loads window boundary information into a plurality of window clipping comparators to define the location and size of the window to be updated. The graphics processor also loads the "template" or "bit mask" identifying window overlap areas into the template memory. Then, the graphics processor simply generates image information, i.e., pixel codes and pixel addresses, and transmits them to the appropriate address and data inputs of the image display memory, without regard to any boundary constraints. The graphics processor also generates a write signal. However, it is applied to a write control circuit, the output of which is applied to a write input of the image memory. The pixel addresses are input to the window clipping comparators, which generate window signals that indicate whether or not the present pixel location (address) is within the predefined boundaries of the window that corresponds to the image for which the present pixel is being generated. The pixel addresses are simultaneously applied to the address inputs of the template memory, which, in response, produces an output or enable signal that indicates whether or not the present pixel is in an obscured area of the present window. The window signals, the template memory output signal, and the write control signal from the graphics processor are operated on by the write control circuit to automatically determine if the present pixel is "obscured" by a higher priority window, and if the present pixel is located inside the present window. If this is the case, the write control circuit generates an image memory write signal and transmits it to the image display memory. Except for updating the template memory and the window clipping comparators each time a different window is to be displayed, the graphics processor does not control the windowing operations, and only needs to generate pixel codes and pixel addresses of the various images corresponding to the various windows. The burden of writing windowing algorithms and allocating computer processing time to execute such window algorithms are thereby avoided. Greatly increased display system operating speed is achieved, and only at the relatively small expense of providing the template memory, the window clipping comparators, and the write control circuit.

DESCRIPTION OF THE INVENTION

Figure 1A:
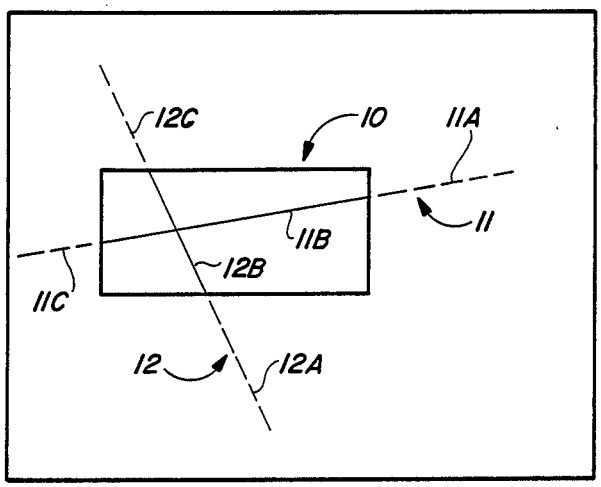
FIG. 1A is a diagram illustrating window clipping.
Figure 1B:
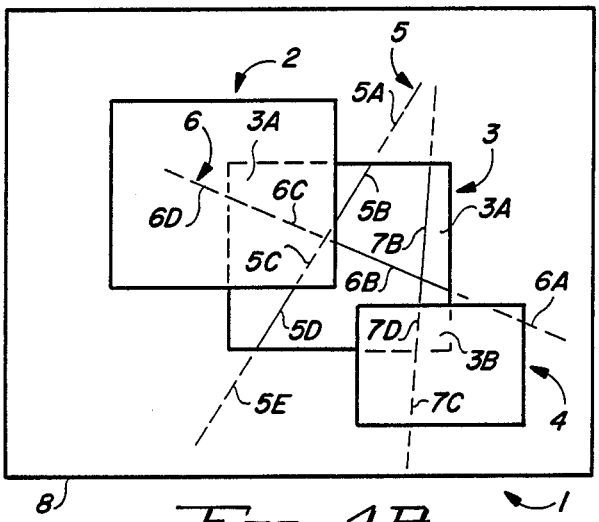
FIG. 1B is a diagram illustrating obscured areas produced by overlapping windows.

Referring first to FIGS. 1A and 1B, it will be helpful to provide a description of the basic windowing procedures to which the present invention relates. Referring first to FIG. 1A, a CRT screen 1 displays images produced by a graphics processor (such as graphics processor 16 in FIG. 2). The graphics program executed by the graphics processor can generate an image that entirely fills screen 1, but also has the capability of displaying a portion of another image in a rectangular window 10 that is, in effect, superimposed upon a portion of the screen 1.

Those skilled in the art will recognize that a graphics processor can, more or less simultaneously, generate graphics information corresponding to a number of different images that may be more or less independent of each other. The graphics processor, in generating pixel data and pixel addresses for each of the various images, "assumes" that it has the entire area of screen 1 available for display of such images. Then, the graphics processor may define a window, such as window 10, within which to display a portion of a particular one of the images. Those skilled in the art use the term "clipping" to refer to a process wherein portions of the image to be "windowed", i.e., appearing within the window 10, must be written into an image display memory, while portions of the same image that lie outside of the window 10, but within the remaining area 8 within screen 1, must be prevented from being written into the display memory, so that the portions of the windowed image outside of the window 10 do not interefere with the image appearing in the remaining area 8 of screen 1.

For example, assume lines 11 and 12 constitute portions of an image to be windowed. Dotted portions 11A and 11C of line 11 fall outside of window 10, and must not be displayed on area 8 of screen 1 and therefore must be "clipped", i.e., prevented from being written into the image display memory. Portion 11B of line 11 falls within window 10, and the pixel codes corresponding to segment 11B must be written into the image display memory so that they will be displayed within window 10. Segment 11C must be clipped. Similarly, portions 12A and 12C of line 12 must be clipped, while portion 12B must be displayed, and clipped, therefore must be written into the image display memory, and ultimately is displayed within window 10.

The window clipping technique referred to with reference to FIG. 1A can, of course, be used for multiple windows in a single screen area. However, if such multiple windows have overlapping portions, then another problem arises, which is now described with reference to FIG. 1B. In FIG. 1B, overlapping windows 2, 3, and 4 are shown within screen 1. Window 2 overlaps, and hence "obscures" a portion 3A of window 3. It can be said that the image of window 2 has a higher priority than the image of window 3. A second window 4 overlaps and obscures an area 3B of window 3. Obviously, the priority of window 4 is greater than that of FIG. 3. (The drawing of FIG. 1B does not indicate whether or not window 2 has a higher priority than window 4.)

When multiple overlapping windows are used, it is not only necessary to "clip" portions of a particular image that fall outside of the window corresponding to that image, it is also necessary to prevent the present pixel data from being written into the image display memory if the present pixel is obscured by a higher priority window, even though that pixel may be within its own corresponding window.

For example, in FIG. 1B, lines 5, 6, and 7 are assumed to be portions of an image that corresponds to window 3. Portions 5A and 5E of line 5 are outside of window 3, and must be clipped. Portions 6A and 6D of line 6 lie outside of window 3 and must be clipped. Portions 7A and 7C lie outside of window 3 and also must be clipped. Solid portions 5B and 5D of line 5 lie within window 3 and must be written into the image display memory so that they can be displayed on screen 1. Dotted portion 5C of line 5, even though it lies within window 3, must not be written into the image display memory because it falls within obscured area 3A of window 3. Similarly, solid portion 6B of line 6 must be written into the image display memory, but dotted portion 6C of line 6 must be inhibited from being written into the image display memory even though it falls within window 3, because it also falls within obscured area 3A. Similarly, solid portion 7B of line 7 must be displayed, while dotted portion 7D falls within obscured area 3B and must not be displayed.

Thus, the only portion of the image associated with window 3 in FIG. 1B that may be written into the image memory is the portion contained within the irregular rectangular shape 3A. Those skilled in the art know that using software techniques to write information that is to be displayed in such a complex shaped area of a screen into its display memory is a difficult, time-consuming task, and the necessary algorithms are expensive to prepare.

Figure 2:
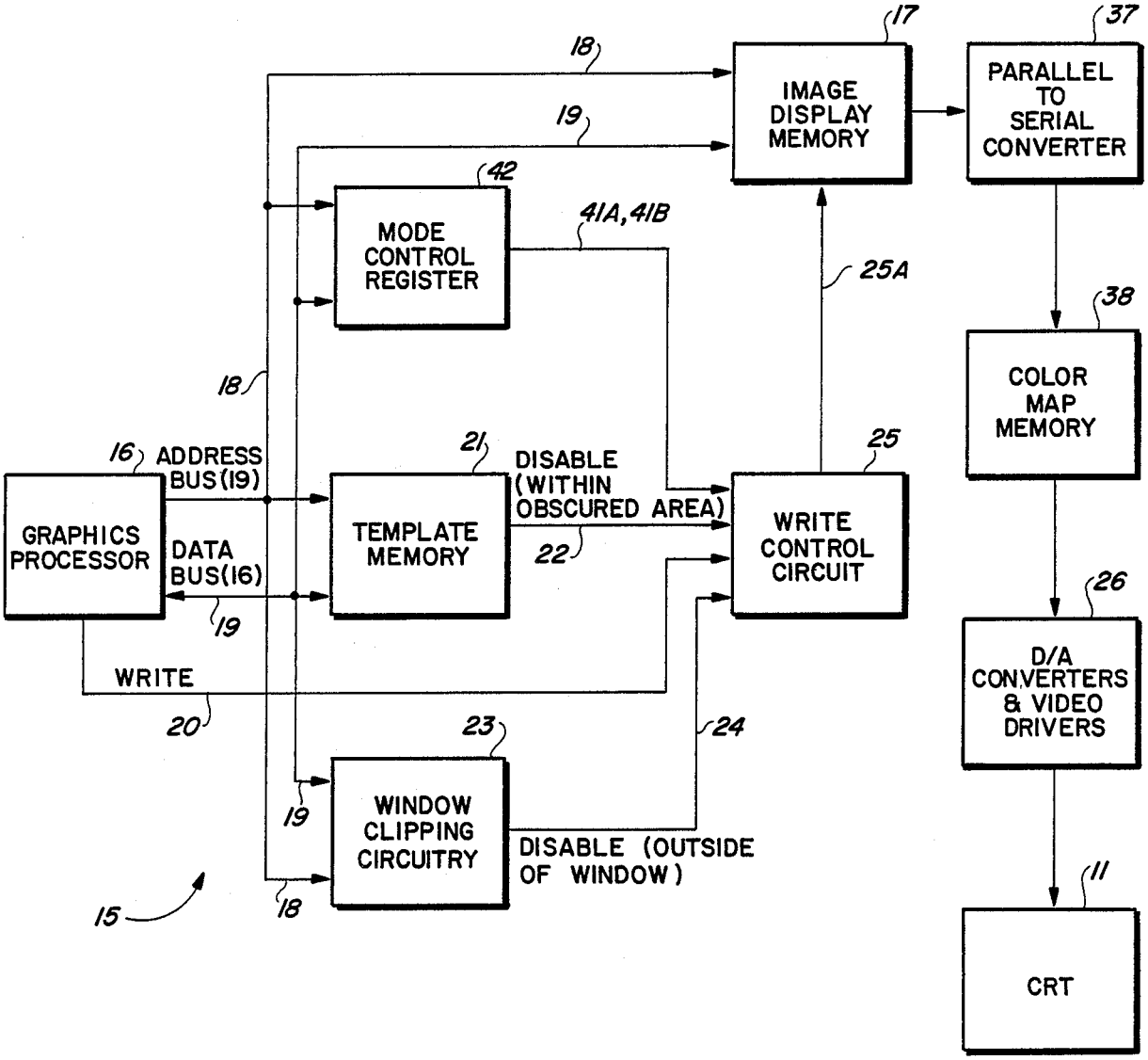
FIG. 2 is a block diagram of the windowing system of the present invention.

Referring now to FIG. 2, the graphics display system 15 of the present invention includes a graphics processor 16, which can be any suitably programmed microcomputer. For the present embodiment of the invention, the graphics processor 16 is implemented by means of a multiprocessing configuration which consists of a National Semiconductor 32000 series processor and a specialized rastor processing machine based on the AMD (advanced micro devices) 29116 bipolar integrated circuit. It produces 19 address outputs on address bus 18, and sixteen data bits on data bus 19. Graphics processor 16 also produces a write signal on conductor 20.

Graphics system 15 also includes an image memory, i.e., a display memory, 17 having 19 address inputs connected to the respective address bus conductors 18 and 19 data input conductors connected to appropriate ones of the data bus conductors 19.

The image display memory 17 is coupled in a suitable manner to a parallel-to-serial converter 37 that, in response to control circuitry that periodically addresses display memory 17, converts the sixteen bit data words produced on the data output conductors of the internal memory chips, and outputs them to a color map memory 38 that stores a color map. The color map is a look-up table with 256 pixel color codes. (Such control circuitry is highly conventional in display memory systems, and therefore is not shown.) Each pixel color code is used to address color map memory 38 to produce a 24 bit code, the three 8-bit parts of which define the red, blue, and green color components of the corresponding pixel, respectively. The three foregoing bytes are transmitted to circuitry in block 26, which contains three digital-to-analog converters and three video drivers, which respectively drive the three conventional inputs of CRT 11, on which the screen 1 of FIGS. 1A and 1B appears.

Image display memory 17 also has a write input that enables image information therein to be updated, under the control of the graphics processor 16.

In accordance with the present invention, window clipping comparator circuitry 23 is provided, and is connected to address bus 18 and data bus 19. A signal is produced on conductor 24 to indicate whether the present pixel, i.e., the pixel whose address or location presently is provided on address bus 18, is within a predefined window, the x and y boundaries of which are stored within comparators of window clipping comparator circuitry 23. Before writing the present image into image display memory 17, the x and y boundaries of each of the windows to be displayed on screen 1 are written into suitable registers within window clipping comparator circuitry 23, by means of data bus 19. More specifically, upper y boundary, lower y boundary, left x boundary, and right x boundary of each window are written into a corresponding register.

Figure 3:
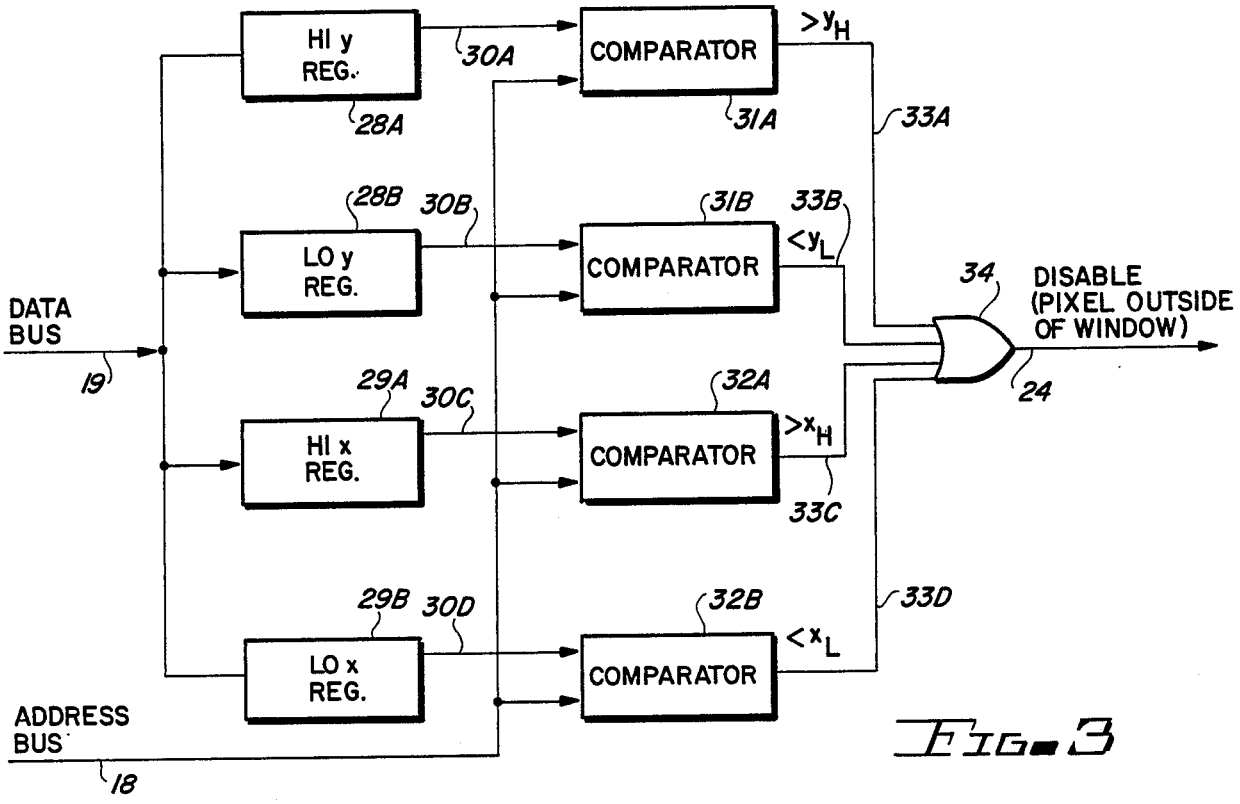
FIG. 3 is a detailed block diagram of the complete window clipping comparator circuit of FIG. 2.

Referring momentarily to FIG. 3, window clipping comparators includes an "upper y" register 28A, a "lower y" register 28B, a "right x" register 29A, and a "left x" register 29B. Each of these registers is loaded from graphics processor 16 via data bus 19. Suitable conductors of the address bus are decoded to select the various registers; the register selection circuitry is easily implemented, and therefore is omitted. The outputs of each of registers 28A and 28B are connected, respectively, to inputs of comparators 31A and 31B. The outputs of registers 29A and 29B are connected to the inputs of comparators 32A and 32B, respectively. Each of the comparators 31A and 31B and 32A and 32B has a second set of comparator inputs that are connected to the respective conductors of address bus 18, so that the address or location of the present pixel can be compared with the boundaries of the window corresponding to that pixel. The outputs 33A–33D of the four comparators are logically ORed by means of OR gate 34 to produce a first write disable signal on conductor 35 if the x or y coordinates of the present pixel exceed the upper limits previously written into registers 28A and 29A or are less than the lower limits previously written into registers 28B and 29B. As a practical matter, the registers such as 28A and the comparators such as 31A are implemented in a single integrated circuit, a 74AS885 eight bit magnitude comparator, obtainable from TI and others.

Reffering again to FIG. 2, a "template" memory 21 has 16 address inputs connected to address bus 18 and 5 data inputs connected to data bus 19. Template memory 21 includes circuitry that produces a second write disable signal on conductor 22, which is applied as an input to write control circuit 25. The write control signal 20 produced by graphics processor 16 is applied as an input to write control circuit 25. The first write disable signal produced on conductor 24 is also applied as an input to write control circuit 25.

In accordance with the present invention, template memory 21 is addressed simultaneously with image display memory 17. Each bit in template memory 21 represents or "maps to" one word, i.e., sixteen horizontally adjacent pixels in the image memory. Although in some instances one might provide one bit in template memory 21 for every pixel code in image memory 17, it is advantageous to have each bit in the template memory represent a number of pixel codes, as this reduces the amount of circuitry required to implement template memory 21, and, more importantly, reduces the amount of time required to load template memory 21. In the presently described embodiment of the invention, the window positioning limitations are such that there was no need to provide any greater resolution than sixteen pixels at the boundaries of the obscured areas represented by the bit mask stored in template memory 21. (Those skilled in the art will recognize that the template memory could be organized to have a different width, i.e., number of bits per word, than disclosed above. Various design constraints may affect the organization selected for the template memory to effectuate efficient concurrent accessing of the template memory and the image memory.)

Before outputting pixel addresses and data on buses 18 and 19, graphics processor 16 first loads a "bit mask" that represents the obscured area of the present window into template memory 21.

If the present pixel being output by graphics processor 16 falls within an area of its window that is overlapped by, and obscured by a higher priority window, a read-out signal or second disable signal is produced by template memory 21 which then is used to disable the write control signal produced on conductor 20 by graphics processor 16. Furthermore, if the present pixel falls within its window, as determined by window clipping comparator circuitry 23, and the present pixel is not obscured, as indicated by the disable signal produced on conductor 22 by template memory 21, then an "image memory" write signal is produced on conductor 21 and applied to the write input of image display memory 10, allowing the present pixel code on data bus 19 to be written into the presently addressed location of image display memory 17.

However, if the present pixel location is outside of its corresponding window, producing a disable on conductor 24, then write control circuit 25 inhibits a write signal from being produced on write conductor 25A, inhibiting or disabling the present pixel code on data bus 19 from being written into image memory 17. If an enable signal is produced on conductor 24, because the present pixel is within its predefined window, but the present pixel is obscured by a higher priority window, a disable signal will be read out of template memory 21 and produced on conductor 22. This will inhibit or disable the write signal on conductor 20 from being gated to conductor 25A, and hence will inhibit the present pixel code on data bus 19 from being written into image display memory 17.

It can be seen that the above inhibiting of pixel codes lying outside of their window areas or lying within obscured areas of their windows is accomplished automatically, once the desired bit masks have been written into the template memory 21 and the window clipping boundaries have been written into the registers of the window clipping comparator circuitry 23.

Figure 4B:
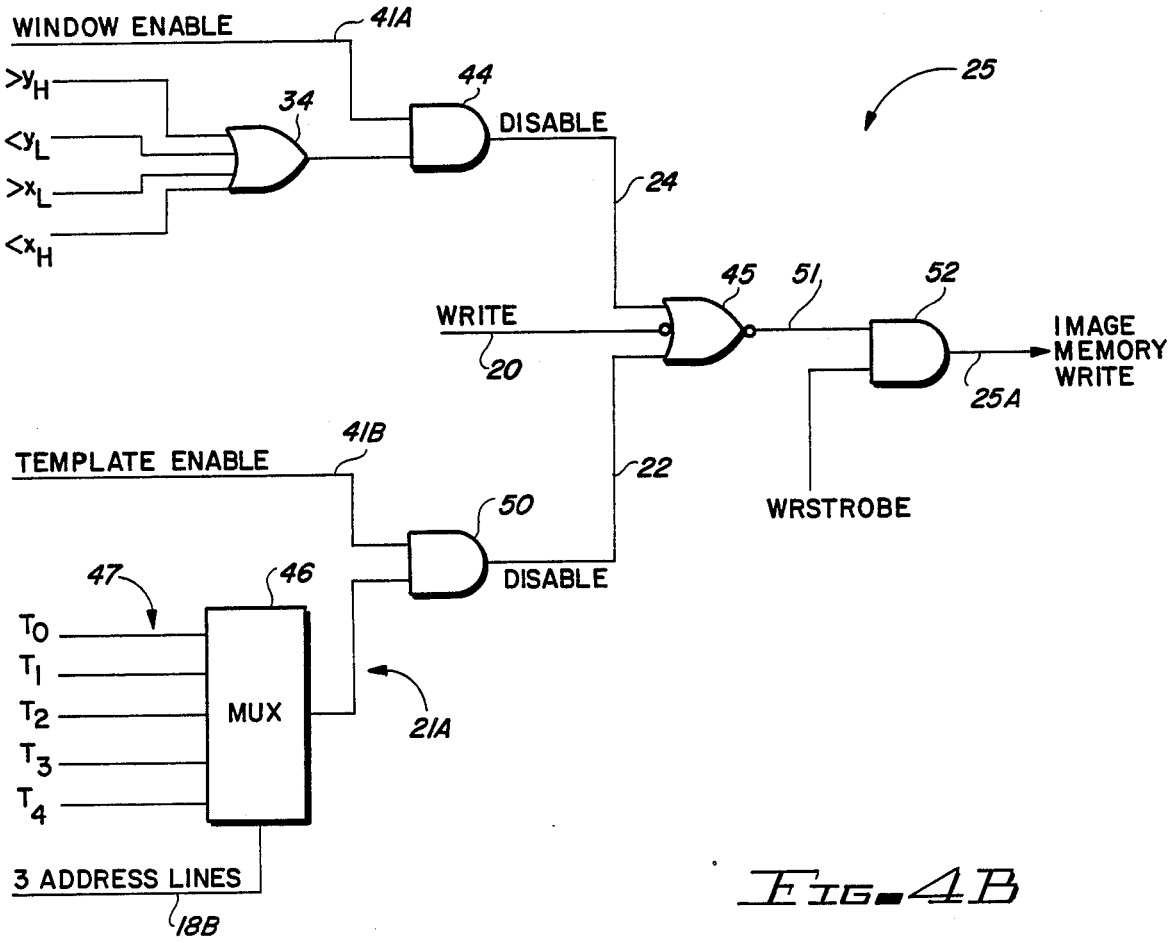
FIG. 4B is a detailed block diagram of the write control circuit contained in FIG. 2.
Figure 4A:
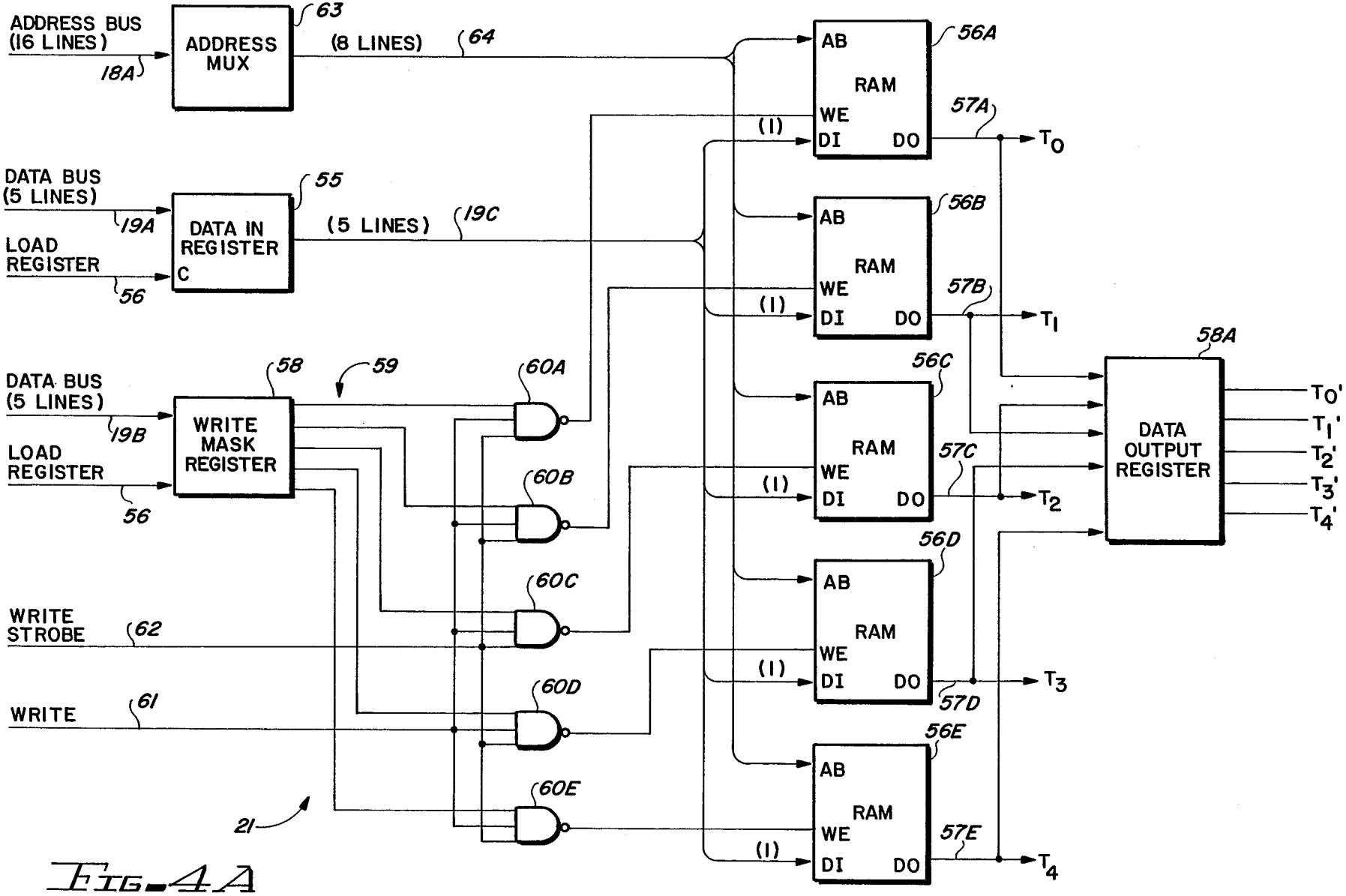
FIG. 4A is a detailed block diagram of the template memory circuit contained in FIG. 2.

A detailed block diagram of template memory 21 is shown in FIG. 4A, wherein five lines 19A of data bus 19 are connected to corresponding inputs of a data input register 55. Data input register 55 is enabled by a "load register" input 56. The template memory is organized as five bits wide, with each bit mapping to one sixteen-bit word in the image memory. Therefore, one word of the five-bit wide template memory maps to five adjacent words, i.e., to 80 adjacent pixels of the image memory.

The five corresponding outputs 19C of data input register 55 are routed to the data in (DI) inputs of five dynamic random access memory (RAM) integrated circuits 56A–56E, respectively. Each of RAMS 56A–56E is a standard 64K by 1 dynamic RAM, such as a Texas Instruments TMS4164, also available from other suppliers. The data out (DO) outputs of the 64K RAMs 56A–E are connected by conductors 57A–57E, respectively, to the inputs of subsequently described multiplexer 46 in FIG. 4B in order to effectuate producing of the template memory disable signal for the addressed image memory word. The data out (DO) outputs of each of 64K RAMs 56A–E also are connected by conductors 57A–57E, respectively, to five inputs of a data output register 58, in order to enable the graphics processor to read the contents of the template memory.

The conventional RAS and CAS (row address strobe and column address strobe) control inputs of the RAM chips 56A–E are easily provided by those skilled in the art, and are not shown.

The write enable (WE) inputs of RAMs 56A–E are connected, respectively, to the outputs of a plurality of five three-input NAND gates 60A–60E. One input of each of the respective NAND gates 60A–60E is connected to a respective one of the output conductors 59 of a five-bit write mask register 58. The corresponding inputs of write mask register 58 are connected to five conductors 19B of data bus 19. The data bus conductors 19B are different than the above-mentioned data bus conductors 19A that are connected to the inputs of data input register 55. Write mask register 58 is loaded in response to load register signal 56 at the same time that the data input register 55 is loaded. One skilled in the art will recognize that the write mask register 58 enables the graphics processor to correct a portion of the template memory that does not lie on any of the five word boundaries of the template memory. This is accomplished by using the write mask register to enable only the desired bits within a word to be updated, thereby avoiding the need for the graphics processor to read out the current contents of the template memory and insert therein the new data by means of an analogous software masking procedure.

A second input of each of the NAND gates 60A–60E is connected to a write signal 61 produced by graphics processor 16. A third input of each of the NAND gates 60A–60E is connected to a write strobe signal 62.

The eight address inputs of each of the RAMs 56A–56E are connected to corresponding conductors 64, which are respectively connected to the outputs of an eight bit row/column address multiplexer 63. The corresponding inputs of address multiplexer 63 are connected to sixteen of the address bus conductors of address bus 18. The other three address conductors are connected to three select inputs of multiplexer 46 of FIG. 4B.

Referring now to FIG. 4B, control circuit 25, which processes inputs from both the template circuit 21 and the window comparator circuitry 23, are shown. Note that for convenience of illustration, a portion of the circuitry contained in template memory 21, namely multiplexer 46 and AND gate 50, are included in FIG. 4B, and similarly, a portion of the window comparator circuitry 23, namely OR gate 34, is also duplicated in FIG. 4B, in order to aid understanding of the operation of the write control circuit 25.

The output circuitry of template memory 21 referred to, multiplexes one of the five data output signals T0–T4 of FIG. 4A, selected by the above-mentioned three address inputs 18B, into AND gate 50, which is enabled by a "template enable" signal on conductor 65 to produce disable signal 22.

The particular one of template memory outputs T0–T4 that is multiplexed onto conductor 49 and conducted to an input of AND gate 50 is selected by one of three address conductors 18B of address bus 18. The disable signal produced on conductor 22 is connected to a non-inverting input of a NOR gate 45, which has two non inverting inputs and one inverting input. The inverting input of NOR gate 45 is connected to write signal 20.

Write control circuit 25 includes, in addition to NOR gate 45, an AND gate 44 having its output connected to the other non-inverting input of NOR gate 45. One input of AND gate 44 is connected to "window enable" signal 41A.

"Window enable" signal 41A and "template enable" signal 41B are produced by a two-bit mode control register 42 of FIG. 2, which is loaded by and selected by data bus 19 and address bus 18, respectively.

The mode control register 42 of FIG. 2 enables the graphics processor to effectively bypass the circuitry including template memory 21 and/or window clipping comparator circuitry 23. This may be desirable in certain situations wherein template memory 21 and/or window clipping comparator circuitry 23 have been updated, but there is a temporary need for the graphics processor to directly update the image display memory 17. The mode control circuit 42 allows this to be done without the need for the graphics processor to first modify the contents of template memory 21 and/or window clipping comparator circuitry 23. The above-mentioned "window enable" signal 41A prevents window comparator circuitry 23 from disabling the write control circuit 20 from being applied to image memory 17. Similarly, the template enable signal 41B prevents template memory 21 from disabling the write control circuit 20 produced by graphics processor 16 from being applied to image memory 17. Provision of the "template enable" input avoids the need for the graphics processor to clear the template memory when there is no obscurred area in the present window.

The other input of AND gate 44 is connected to the output of OR gate 40, which has four inputs that are connected to the window comparator circuit outputs 33A, 33B, 33C, and 33D. The output of NOR gate 45 is connected to conductor 51, which is also connected to one input of AND gate 52. The other input of AND gate 52 is connected to write strobe conductor 62. The output of AND gate 52 produces the image memory write signal 25A. A write strobe (WRSTROBE) signal on conductor 62, which is generated during every memory cycle, is applied to the other input of AND gate 52. Those skilled in the art will recognize that NOR gate 45 actually performs a logical ANDing function upon the logic signals applied to its input.

The basic operating procedure is that the graphics processor software defines the window area that is desired to be updated, by computing its rectangular window boundaries and writing them into the appropriate registers 28A, 28B, 29A, and 29B of FIG. 3. The graphics processor software also determines any obscured areas that result from simultaneous display of higher priority windows. For the present window to be updated, the graphics processor software, in the described embodiment of the invention, writes one bit for each group of sixteen horizontally adjacent pixels within the overlapped areas into the template memory 21 to produce the above-described bit mask. The graphics processor then continues to generate graphic images to be displayed within the present window, and outputs appropriate pixel data and pixel addresses, both of which are transmitted via the data bus 19 and the address bus 18 to appropriate address and data terminals of the image display memory 17. Simultaneously, the address of the present pixel is input to the comparators 31A, 31B, 32A, and 32B of FIG. 3 and is thereby compared with the present window boundaries, to generate the signals on conductors 33A–33D that indicate whether the present pixel is outside one of the present window boundaries. Also, the present pixel address is used to access the template memory 21, which outputs the addressed bit of the bit mask. Since each bit in the bit mask correspond to sixteen pixels, the least significant four address bits of the image display memory address are not applied to the template memory 21. If any of the four window comparator output signals 33A–33D are a logical "one", OR gate 34 in FIG. 4B produces a disable input to NOR gate 45, preventing the write signal 20 from enabling the image memory write signal 25A from being applied to the image display memory 17. Similarly, if the present pixel is within an obscured area, a selected one of the templet memory outputs T0–T4 will be multiplexed by multiplexer 46, conductor 49, AND gate 50, to conductor 22 to disable the write signal 20 from being gated to the image display memory write input 25A. (The foregoing discussion assumes that both the "window enable" signal 41A and the "template enable" signal 41B are "ones".

It should be noted that the template memory concept as applied to template memory 21 could just as easily be applied to window clipping comparator circuitry 23. Instead of loading rectangular boundaries into comparator registers in the window clipping circuit, round, trapezoidal, or otherwise irregular window areas could be loaded into a second template memory that replaces window clipping comparator circuitry 23. This approach, however, requires more processing time by the graphics processor in order to fill the memory with the desired mask. The approach that we have taken, using a template memory and window clipping comparators, provides the advantage that the template memory 21 needs to be only updated in the area of the window to be updated.

The above-described technique provides the substantial advantages of allowing a decision as to whether or not the graphics processor is to write into the image memory to be made simultaneously with the access of the image memory. The graphics processor software needs only to determine which window areas of the present window are obscured by a higher priority window and write the bit mask area corresponding to that obscured area into the template memory 21. While the invention has been described with reference to a particular embodiment thereof, those skilled in the art will be able to make various modifications to the described embodiment of the invention without departing from the true spirit and scope thereof. It is intended that graphics display windowing apparatus and methods which are equivalent to those described herein in that the various elements or steps perform substantially the same function in substantially the same way to accomplish substantially the same result are within the scope of the invention. For example, the graphics processor might determine the co-extensive areas of all of the windows to be displayed in the course of executing particular software, and combinatorial logic might be provided to determine which areas of the present window, i.e., the window within which corresponding locations of the image memory are being updated, are obscured. Multiple window defining circuitry, such as the above-described window comparator circuitry could be provided for each window, and the outputs thereof could be indicative of the priority of each window as well as whether or not the present pixel is within that window. Gating circuitry responsive to such outputs and to a bit mask representing all co-extensive window areas stored in a template memory could then produce the needed image memory write disable signals.

We claim:

1. A display system including a display screen and an image memory, the display system comprising in combination:

(a) first means for determining the addresses of pixels of a first group that are located within a first window of the display screen area, within which first window a portion of a first image is to be displayed, and second means for determining the addresses of pixels of a second group that are located within a second window of the display screen area, within which second window a portion of a second image of higher priority than the first image is to be displayed, the second window obscuring an area of the first window;

(b) means for storing a bit mask, the bit mask constituting a plurality of bits that are respectively addressable by a plurality of the addresses of pixels of the first group;

(c) means for writing the bits of the bit mask into locations of the bit mask storing mans defined by the addresses of the pixels of the first group;

(d) means for transmitting pixel data and pixel addresses of pixels of the first group to the image memory, and concurrently transmitting those pixel addresses to the bit mask storing means;

(e) means for outputting a bit signal from the bit mask storing means in response to the address presently being transmitted to produce a first write disable signal if the pixel bears a predetermined relationship to the first group and the obscured area; and (f) means for disabling the pixel from being written into the image memory in response to the first write disable signal.

2. The display system of claim 1 wherein the predetermined relationship is that the pixel the address of which is being transmitted is in the first group and the obscured area.

3. The display system of claim 2 including means for transmitting pixel codes of a pixel to the image memory, the address of which pixel is being transmitted.

4. The display system of claim 2 wherein the first and second address determining means are included in a processor for executing an image generating program for producing the first image and the second image.

5. The display system of claim 4 wherein the pixel disabling means includes write control circuit means, having a first input responsive to a write signal produced by the processor and a second input responsive to the first write disable signal, for disabling a write signal produced by the processor if the pixel the address of which is being transmitted is in the first group and otherwise gating the write signal to a write input of the image memory.

6. The display system of claim 5 including means in the processor for determining the address boundaries of a window to be displayed on the display screen area.

7. The display system of claim 6 including means for storing the address boundaries and means for writing the address boundaries from the processor into the address boundary storing means.

8. The display system of claim 7 including means for comparing the pixel address being transmitted with the address boundaries stored in the address boundary storing means to produce a second write disable signal if the pixel the address of which is being transmitted falls outside of the window defined by the stored address boundaries.

9. The display system of claim 8 wherein the write control circuit means includes a third input responsive to the second write disable signal, and means responsive to the second write disable signal for disabling the write signal from being gated to a write input of the image memory if the pixel the address of which is being transmitted falls outside of the window.

10. The display system of claim 9 including means for periodically accessing the image memory to obtain pixel codes therefrom and operating on those pixel codes to refresh the display screen area.

11. The display system of claim 2 wherein the first window includes at least one rectangular area.

12. The display system of claim 2 wherein the first window includes at least one non-rectangular area.

13. The display system of claim 1 wherein the predetermined relationship is that the pixel the address of which is being transmitted is outside of the first group and is located outside of the first window.

14. The display system of claim 13 wherein the first window includes at least one non-rectangular area.

15. The display system of claim 1 wherein each of the bits of the bit mask is addressable by fewer than all of the binary address bits required to define the address of a pixel code in the image memory.

16. A display sytem including a display screen area and an image memory, the display system comprising in combination:

(a) means for determining the addresses of pixels of a first group that are located within an obscured area of a predetermined window of the display screen area within which a poriton of a predetermined image is to be displayed;

(b) means for storing a bit mask constituting a plurality of bits that are respectively addressable by addresses of pixels of the first group;

(c) means for writing the bits of the bit mask into locations of the bit mask storing means defined by the addresses of the pixels of the first group;

(d) means for transmitting pixel data and pixel addresses of pixels of the first group to the image memory, and concurrently transmitting those pixel addresses to the bit mask storing means;

(e) means for causing the bit mask storing means to output a bit that corresponds, respectivey, to an address presently being transmitted to the image memory, in order to produce a write disable signal if a pixel code presently being transmitted to the image memory is located within an obscured area represented by the stored bit mask; and (f) means for disabling the write signal from being applied to a write input of the image memory in response to the output bit produced by the bit mask storing means if the present pixel is within the obscured area represented by the bit mask.

17. A method of operating a display system including a display screen area and an image memory, the method comprising the steps of:

(a) determining the addresses of pixels of a first group that are located within a first window of the display screen area, within which first window a portion of a first image is to be displayed, and determining the addresses of pixels of a second group that are located with a second window of the display screen area, within which second window a portion of a second image of higher priority than the first image is to be displayed, the second window obscuring an area of the first window;

(b) writing a plurality of bits that constitute a first bit mask into locations of a bit mask storing means that area respectively addressable by the addresses determined in step (a);

(c) transmitting pixel data and pixel addresses of pixels of the first group to the image memory, and concurrently transmitting those pixel addresses to othe bit mask storing means;

(d) outputting a bit signal from the bit mask storing means in response to the address presently being transmitted to produce a write disable signal if the pixel presently being transmitted to the bit mask storing means bears a predetermined relationship to the first group and the obscured area; and (e) disabling the first pixel from being written into the image memory in response to the write disable signal.

18. The method of claim 17 wherein steps (c) through (e) of claim 17 are repeated for additional pixels.

19. The method of claim 17 wherein the predetermined relationship is that the pixel the address of which is being transmitted is in the first group and the obscured area.

20. The method of claim 19 including transmitting the pixel code of the fist pixel to the image memory.

21. The method of claim 20 including performing step (a) by means of a processor and using the processor to excute an image generating program to produce the first image and a second image, a portion of which is to be displayed within the second window.

22. The method of claim 21 wherein step (e) includes disabling a write signal produced by the processor if the pixel the address of which is being transmitted is in the first group and otherwise gating the write signal to a write input of the image memory.

23. The method of claim 22 including determining the address boundaries of a window to be displayed on the display screen area.

24. The method of claim 23 including providing means for storing the address boundaries, and performing the step of writing the address boundaries into the address boundary storing means.

25. The method of claim 24 including comparing the address of the first pixel with the address boundaries stored in the address boundary storing means to produce a second write disable signal if the first pixel falls outside of the window defined by the stored address boundaries.

26. The method of claim 25 including periodically accessing the image memory to obtain pixel codes therefrom and operating on those pixel codes to refresh the display screen area.

27. The method of claim 19 wherein the predetermined area includes at least one rectangular area.

28. The method of claim 19 wherein the predetermined area includes at least one non-rectangular area.

29. The method of claim 17 wherein the predetermined relationship is that the pixel the address of which is being transmitted is outside of the first group and is located outside of the first window.

30. The method of claim 29 wherein the predetermined area includes at least one non-rectangular area.

31. The method of claim 17 wherein each of the bits of the bit mask is addressable by fewer than all of the binary address bits required to define the address of a pixel code in the image memory.

32. A method of operating a display system including a display screen area and an image memory, the method comprising the steps of:

(a) determining the addresses of pixels of a first group that are located within an obscured area of a first window of the display screen area within which a portion of a first image is to be displayed;

(b) writing a plurality of bits that constitute a bit mask into locations of a first bit mask storing means that are respectively addressable by addresses of the pixels of the first group;

(c) transmitting pixel data and pixel addresses of pixels of the first group and corresponding write commands to the image memory, and concurrently transmitting those pixel addresses to the bit mask storing means;

(d) causing the bit mask storing means to output bits that correspond to addresses presently being transmitted to the image memory to produce a first write disable signal if the pixel code presently being transmitted to the image memory is located within an obscured area represented by the stored bit mask; and (e) in response to the first disable signal, disabling the write signal from being applied to a write input of the image memory if the present pixel is within an obscured area represented by the bit mask.

33. The method of claim 32 wherein step (a) includes using operating a graphics processor to execute a program that determines the obscured area by determining the areas of the first window that are overlapped by a higher priority second window.

34. The method of claim 32 including the steps of determining the address boundaries of the first window and writing the address boundaries into a comparing means prior to step (c);

concurrently with step (c), transmitting those pixel addresses to the comparing means;

comparing the pixel addresses presently being transmitted to the comparing means with the address boundaries into the comparing means to produce a second write disable signal if the pixel address presently being transmitted to the comparing means falls outside of the address boundaries in the comparing means; and in response to the second disable signal, disabling the write signal from being applied to the write input of the image memory if the pixel address presently being transmitted to the comparing means falls outside of the first window.

* * * * *